US011686485B2

(12) United States Patent
Charillon et al.

(10) Patent No.: US 11,686,485 B2
(45) Date of Patent: Jun. 27, 2023

(54) FACILITY DISINFECTANT AND PESTICIDE DISTRIBUTION SYSTEM

(71) Applicant: BioSans LLC, Corrales, NM (US)

(72) Inventors: Gregoire P. Charillon, Placitas, NM (US); James Wayne Berry, Corrales, NM (US)

(73) Assignee: BIOSANS LLC, Corrales, NM (US)

( * ) Notice: Subject to any disclaimer, the term of this patent is extended or adjusted under 35 U.S.C. 154(b) by 63 days.

(21) Appl. No.: 17/313,991

(22) Filed: May 6, 2021

(65) Prior Publication Data

US 2022/0018559 A1 Jan. 20, 2022

Related U.S. Application Data

(60) Provisional application No. 63/053,456, filed on Jul. 17, 2020.

(51) Int. Cl.

| | |
|---|---|
| ***F24F 8/24*** | (2021.01) |
| ***F24F 11/49*** | (2018.01) |
| *F24F 11/58* | (2018.01) |
| *F24F 120/10* | (2018.01) |

(52) U.S. Cl.

CPC ..... *F24F 8/24* (2021.01); *F24F 11/49* (2018.01); *F24F 11/58* (2018.01); *F24F 2120/10* (2018.01)

(58) Field of Classification Search

CPC ..... F24F 8/24; F24F 11/49; F24F 2120/10; F24F 11/58; Y02A 50/20; A61L 2/22; A61L 2/10

See application file for complete search history.

(56) References Cited

U.S. PATENT DOCUMENTS

| | | | | |
|---|---|---|---|---|
| 3,742,520 | A | 7/1973 | Bernard | |
| 5,660,330 | A | 8/1997 | Scott | |
| 6,463,694 | B1 | 10/2002 | Manciet | |
| 6,588,225 | B1 * | 7/2003 | Hodgson | F25B 39/02 62/93 |
| 7,908,791 | B1 | 3/2011 | Brash | |
| 8,303,905 | B2 | 11/2012 | Brents et al. | |
| 11,160,890 | B1 * | 11/2021 | Lytle | A61L 2/10 |
| 2009/0263499 | A1 | 10/2009 | Platt, Jr. et al. | |
| 2011/0315175 | A1 * | 12/2011 | Lella | A61L 2/22 134/56 R |
| 2014/0209330 | A1 * | 7/2014 | Statter | H04N 19/176 169/61 |

(Continued)

FOREIGN PATENT DOCUMENTS

| | | | |
|---|---|---|---|
| EP | 0558919 | A1 * | 9/1993 |
| KR | 102094714 | B1 * | 3/2020 |

OTHER PUBLICATIONS

International Search Report and Written Opinion for International Application No. PCT/US21/32102, dated Oct. 6, 2021, 12 pages.

*Primary Examiner* — Alicia M. Choi

(74) *Attorney, Agent, or Firm* — Loza & Loza LLP; Kevin Soules

(57) ABSTRACT

Systems and methods for distributing treatment compound to an enclosed environment comprise a storage and distribution assembly for storing a treatment compound, a pipe system for delivering the treatment compound from the storage tank to an environment and an exhaust system configured to exhaust the treatment compound out of the environment.

20 Claims, 9 Drawing Sheets

(56) References Cited

U.S. PATENT DOCUMENTS

| | | | | |
|---|---|---|---|---|
| 2015/0258233 | A1* | 9/2015 | Brown | A61L 2/22 422/292 |
| 2018/0220639 | A1 | 8/2018 | Kim | |
| 2019/0086117 | A1* | 3/2019 | Daly | F24F 13/1426 |
| 2021/0046204 | A1* | 2/2021 | Grinstead | A61L 2/22 |
| 2021/0393840 | A1* | 12/2021 | Maben | B64D 13/06 |
| 2022/0018559 | A1* | 1/2022 | Charillon | F24F 8/24 |
| 2022/0096701 | A1* | 3/2022 | Pisharodi | A61L 9/20 |

* cited by examiner

FACILITY DISINFECTANT AND PESTICIDE DISTRIBUTION SYSTEM

CROSS REFERENCE TO RELATED PATENT APPLICATION

This patent application claims the priority and benefit, under 35 U.S.C. § 119(e), of U.S. Provisional Patent Application Ser. No. 63/053,456, filed Jul. 17, 2020, and titled "FACILITY DISINFECTANT AND PESTICIDE DISTRIBUTION SYSTEM". U.S. Provisional Application Ser. No. 63/053,456 is incorporated herein by reference in its entirety.

TECHNICAL FIELD

Embodiments are generally related to the field of facility and building maintenance. Embodiments are also related to the field of sanitization of enclosed environments. Embodiments are also related to the field of pesticide distribution. Embodiments are further related to the field of automated distribution and capture of disinfectants and pesticides in enclosed environments. Embodiments are also related to systems and methods for automated and batched facility and building disinfectant and pesticide distribution systems.

BACKGROUND

Sanitization of commonly occupied enclosures has quickly become a critically important mechanism for the control of infectious disease. Certain pathogens have been shown to live on surfaces and/or in the air for days or even weeks. Thus, in commonly occupied areas, it is necessary to thoroughly clean and disinfect in order to prevent the spread of disease. Likewise, pests, such as mice, rats, and insects can serve as vectors for the spread of disease. Most large facilities require routine pest treatment to reduce pest infestations.

Current methods for cleaning and/or disinfecting enclosed areas generally involve manual labor. These methods are time tested, but also expose those tasked with cleaning to any infectious diseases in the environment, putting them at high risk of illness or death. Not only are janitorial services risky for janitorial staff, they are also expensive. Large buildings, such as office buildings, hotels, and the like require a large maintenance staff to provide the necessary disinfecting and pest treatment.

Staff are often required around the clock, particularly in hotels, so that as a room is vacated it can be cleaned and disinfected before the next guest enters the room. Each room may even require a team of staff members to clean and disinfect. For purposes of efficiency, this means, in many cases, multiple teams or staff are required to disinfect rooms in parallel.

Prior approaches to disinfecting enclosed areas thus expose staff to unnecessary risks, are inefficient, and are expensive. As such, there is a need in the art for methods and systems that provide safer and more efficient means of disinfecting enclosed spaces as detailed herein.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method, system, and apparatus for disinfecting enclosed environments.

It is another aspect of the disclosed embodiments to provide a method, system, and apparatus for treating enclosed environments for pests.

It is another aspect of the disclosed embodiments to provide a method, system, and apparatus for distributing and collecting disinfecting and pest treatment agents in an enclosed environment.

It is another aspect of the disclosed embodiments to provide a method, system, and apparatus for automated distribution and collection of disinfecting agents and pest treatment agents in office buildings, hotels, residential buildings, apartments, commercial spaces, and the like.

The aforementioned aspects and other objectives and advantages can now be achieved as described herein. In an exemplary embodiment, a compound distribution system comprises a storage and distribution assembly for storing a treatment compound, a pipe system for delivering the treatment compound from the storage tank to an environment, and an exhaust system configured to exhaust the treatment compound out of the environment.

In an embodiment, the system further comprises a computer system communicatively coupled to other elements of the system, the computer system comprising: at least one processor and a storage device communicatively coupled to the at least one processor, the storage device storing instructions which, when executed by the at least one processor, cause the at least one processor to perform operations comprising: controlling distribution of the treatment compound from the storage and distribution assembly to the environment, and controlling the exhaust system to exhaust the treatment compound out of the environment.

In certain embodiments, the storage and distribution assembly further comprises: a main storage tank, at least one compound tank configured to supply treatment compound to the main tank, and a compressed gas assembly configured to provide compressed gas to the main storage tank. In certain embodiments, the pipe system further comprises: a main distribution line, a main distribution valve in the main distribution line, at least one room distribution line, and a room distribution line valve associated with each of the at least one room distribution lines. In certain embodiments, the exhaust system further comprises at least one vent in the environment, at least one vent fan configured to draw and/or evacuate fluid out of the environment through the at least one vent, and an exhaust vent configured to expel the treatment compound.

In another embodiment, a distribution and exhaust system comprises at least one room box configured to deliver treatment compound to a nozzle disposed in an environment, at least one zone box configured for delivering a treatment compound to the at least one room box, and an exhaust system configured to exhaust the treatment compound out of the environment. In an embodiment, the distribution and exhaust system further comprises a main box configured to provide at least one component of the treatment compound to the zone box. In an embodiment, the distribution and exhaust system further comprises an air compressor in fluidic connection with at least one of the zone box and the room box.

In an embodiment, the distribution and exhaust system further comprises a dryer configured between the air compressor and at least one of the zone box and the room box and a filter configured between the air compressor and at least one of the zone box and the room box. In an embodiment, the zone distribution box further comprises a main storage tank and at least two compound tanks configured to supply treatment compound to the main tank. In an embodiment, the exhaust system further comprises at least one vent in the environment at least one vent fan configured to draw fluid out of the environment through the at least one vent and an exhaust vent configured to expel the treatment compound.

In another embodiment the distribution and exhaust system further comprises a computer system communicatively coupled to at least one of the zone box and the room box, and the exhaust system, the computer system comprising at least one processor, and a storage device communicatively coupled to the at least one processor, the storage device storing instructions which, when executed by the at least one processor, cause the at least one processor to perform operations comprising: controlling the zone box, controlling distribution of the treatment compound with the room box, and controlling the exhaust system to exhaust the treatment compound out of the environment.

In an embodiment, the at least one room box comprises a plurality of room boxes associated with one of the at least one zone boxes.

In another embodiment, a treatment method comprises storing a treatment compound in a storage and distribution assembly, delivering the treatment compound from the storage and distribution assembly to an environment with a pipe system, and exhausting the treatment compound out of the environment with an exhaust system. In an embodiment, the treatment method further comprises controlling distribution of the treatment compound from the storage and distribution assembly to the environment with a computer system, and controlling the exhaust system to exhaust the treatment compound out of the environment, with the computer system. In an embodiment the storage and distribution assembly further comprises: a main storage tank, at least one compound tank configured to supply treatment compound to the main tank, and a compressed gas assembly configured to provide compressed gas to the main storage tank. In an embodiment, the treatment method further comprises a main distribution line, a main distribution valve in the main distribution line, at least one room distribution line, and a room distribution line valve associated with each of the at least one room distribution lines. In an embodiment, The treatment method further comprises opening at least one vent in the environment, drawing fluid out of the environment through the at least one vent with at least one vent fan, and expelling the treatment compound through an exhaust vent. In an embodiment, the treatment method further comprises verifying the environment is vacant with an occupancy detector before delivering treatment compound to the environment. In an embodiment, the treatment method further comprises scheduling delivery of the treatment compound to an environment.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
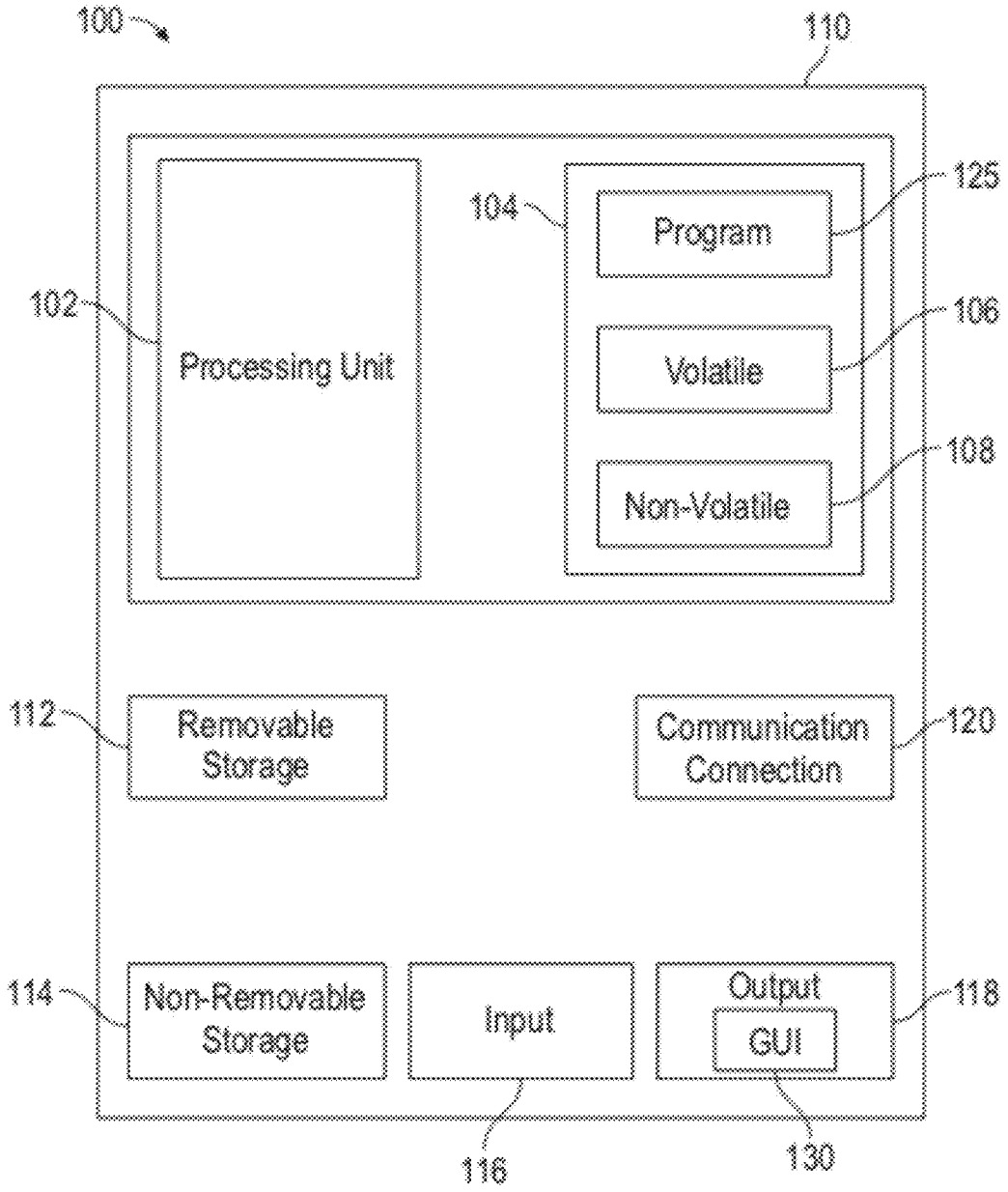
FIG. 1 depicts a block diagram of a computer system which is implemented in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "microwave" as used herein, refers to a particular radiofrequency wave generating mechanism, but does not exclude any other radiofrequency wave generating systems.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and," "or," or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As disclosed herein the term "enclosed environment," or any variant thereof, can refer to any indoor environments, such as, but not limited to healthcare facilities, doctor's offices, schools, gyms, conference facilities, commercial kitchens and cafeterias, workspaces, casinos, veterinary facilities and kennels, nursing homes, offices, childcare facilities, waiting areas, lounges, airports, fitness studios, spas, mortuaries, churches, conference centers, restaurants, performance venues, libraries, retail stores, correctional facilities, lodging and hospitality enclosures, areas where disease and biological contamination is concentrated, public spaces, transportation infrastructure, such as, but not limited to trains, subways, buses, cars, trucks, taxis, boats, yachts, ships, aircraft, recreational vehicles, and other such vehicles.

As used herein the term "gas" refers to any gas of any kind, including but not limited to, nitrogen, oxygen, argon, inert gases, ambient air, combinations or mixtures of gasses, or any other molecule in a gaseous state. As used herein the term "fluid" is to be given its standard meaning in the art and can include liquids, gasses, plasmas, sprays, mists, fogs, and other such substances that deform under external force.

Figure 2:
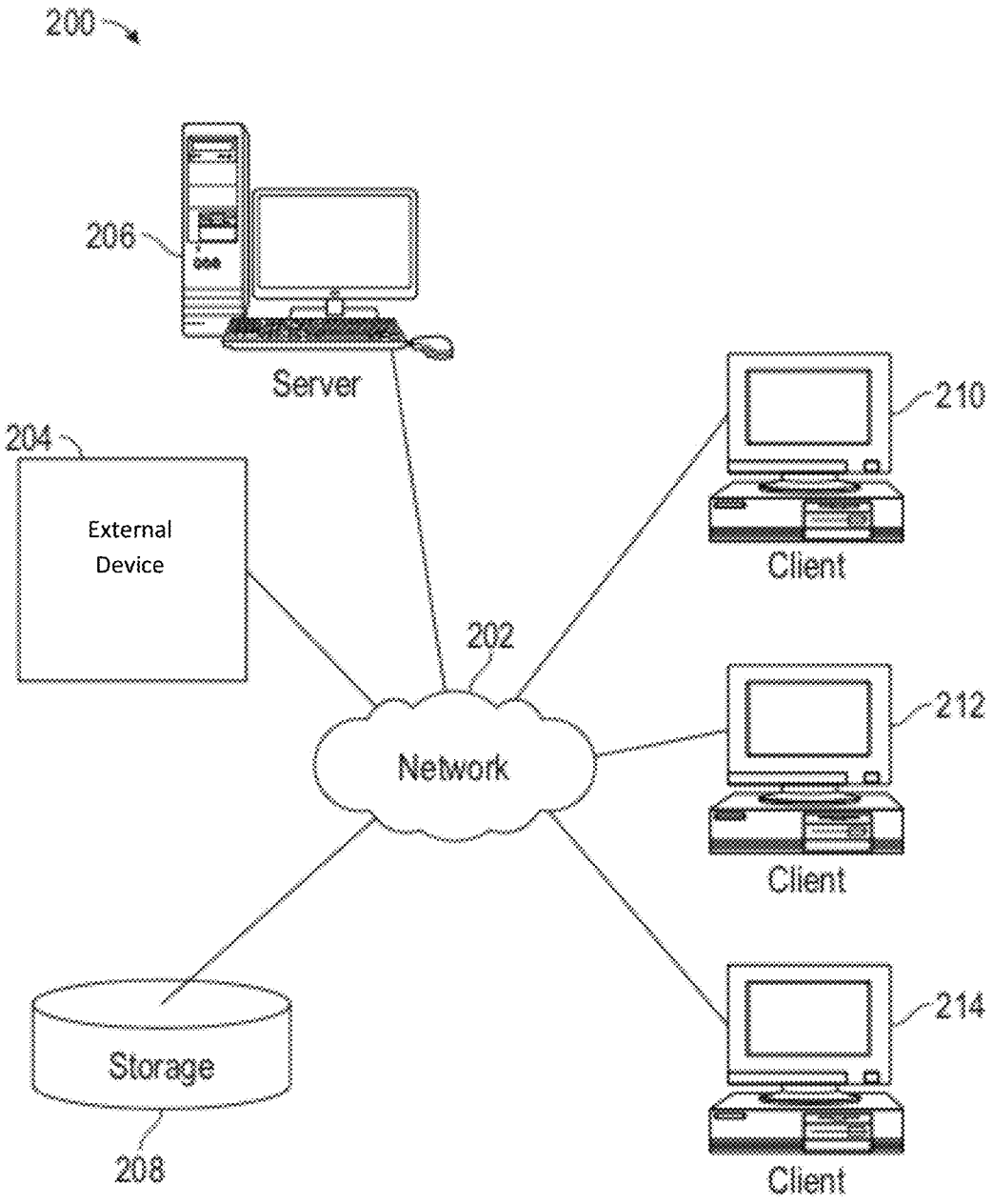
FIG. 2 depicts a graphical representation of a network of data-processing devices in which aspects of the present embodiments may be implemented.
Figure 3:
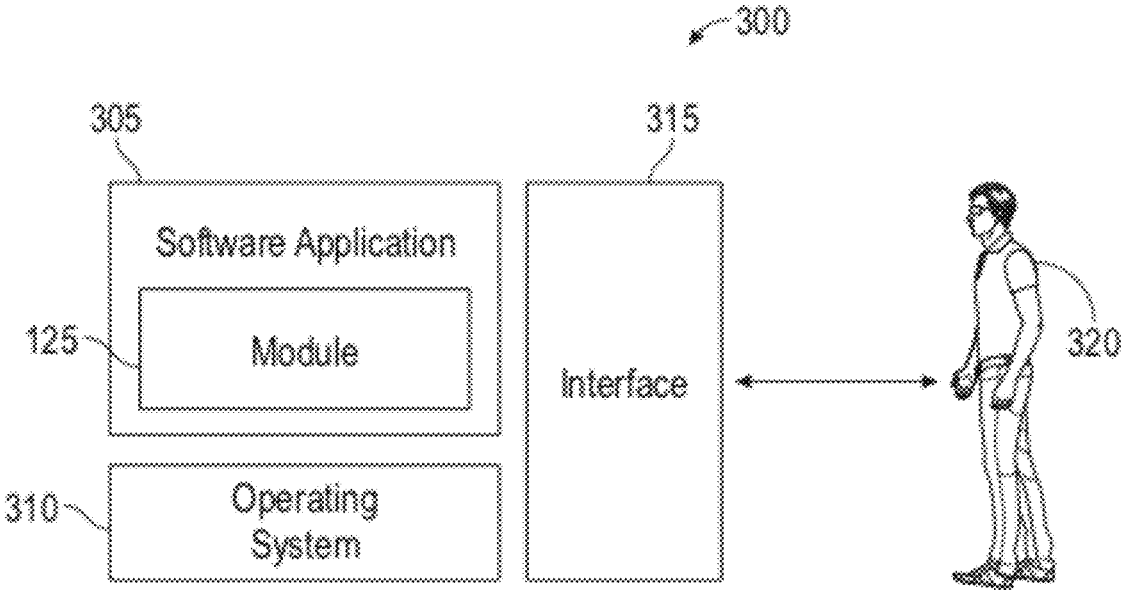
FIG. 3 depicts a computer software system for directing the operation of the data-processing system depicted in FIG. 1, in accordance with an embodiment.

FIGS. 1-3 are provided as exemplary diagrams of data-processing environments in which embodiments disclosed herein may be implemented. It should be appreciated that FIGS. 1-3 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

A block diagram of a computer system 100 that executes programming for implementing parts of the methods and systems disclosed herein is shown in FIG. 1. A computing device in the form of a computer 110 configured to interface with sensors, peripheral devices, and other elements disclosed herein may include one or more processing units 102, memory 104, removable storage 112, and non-removable storage 114. Memory 104 may include volatile memory 106 and non-volatile memory 108. Computer 110 may include or have access to a computing environment that includes a variety of transitory and non-transitory computer-readable media such as volatile memory 106 and non-volatile memory 108, removable storage 112 and non-removable storage 114. Computer storage includes, for example, random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage, or other magnetic storage devices, or any other medium capable of storing computer-readable instructions as well as data including image data.

Computer 110 may include or have access to a computing environment that includes input 116, output 118, and a communication connection 120. The computer may operate in a networked environment using a communication connection 120 to connect to one or more remote computers, remote sensors, detection devices, hand-held devices, multi-function devices (MFDs), mobile devices, tablet devices, mobile phones, Smartphones, or other such devices. The remote computer may also include a personal computer (PC), server, router, network PC, RFID enabled device, a peer device or other common network node, or the like. The communication connection may include a Local Area Network (LAN), a Wide Area Network (WAN), Bluetooth connection, or other networks. This functionality is described more fully in the description associated with FIG. 2 below.

Output 118 is most commonly provided as a computer monitor, but may include any output device. Output 118 and/or input 116 may include a data collection apparatus associated with computer system 100. In addition, input 116, which commonly includes a computer keyboard and/or pointing device such as a computer mouse, computer track pad, or the like, allows a user to select and instruct computer system 100. A user interface can be provided using output 118 and input 116. Output 118 may function as a display for displaying data and information for a user, and for interactively displaying a graphical user interface (GUI) 130.

Note that the term "GUI" generally refers to a type of environment that represents programs, files, options, and so forth by means of graphically displayed icons, menus, and dialog boxes on a computer monitor screen. A user can interact with the GUI to select and activate such options by directly touching the screen and/or pointing and clicking with a user input device 116 such as, for example, a pointing device such as a mouse and/or with a keyboard. A particular item can function in the same manner to the user in all applications because the GUI provides standard software routines (e.g., module 125) to handle these elements and report the user's actions. The GUI can further be used to display the electronic service image frames as discussed below.

Computer-readable instructions, for example, program module or node 125, which can be representative of other modules or nodes described herein, are stored on a computer-readable medium and are executable by the processing unit 102 of computer 110. Program module or node 125 may include a computer application. A hard drive, CD-ROM, RAM, Flash Memory, and a USB drive are just some examples of articles including a computer-readable medium.

FIG. 2 depicts a graphical representation of a network of data-processing systems 200 in which aspects of the present embodiments may be implemented. Network data-processing system 200 is a network of computers or other such devices such as mobile phones, smartphones, sensors, detection devices, controllers and the like in which embodiments may be implemented. Note that the system 200 can be implemented in the context of a software module such as program module 125. The system 200 includes a network 202 in communication with one or more clients 210, 212, and 214. Network 202 may also be in communication with one or more devices 204, servers 206, and storage 208. Network 202 is a medium that can be used to provide communications links between various devices and computers connected together within a networked data processing system such as computer system 100. Network 202 may include connections such as wired communication links, wireless communication links of various types, fiber optic cables, quantum, or quantum encryption, or quantum teleportation networks, etc. Network 202 can communicate with one or more servers 206, one or more external devices such as a controller, actuator, sensor, tank, valve, fan, pump, control system, other internet of things (IOT) enabled device, or other such device 204, and a memory storage unit such as, for example, memory or database 208. It should be understood that device 204 may be embodied as a detector device, microcontroller, controller, receiver, transceiver, or other such device.

In the depicted example, external device 204, server 206, and clients 210, 212, and 214 connect to network 202 along with storage unit 208. Clients 210, 212, and 214 may be, for example, personal computers or network computers, handheld devices, mobile devices, tablet devices, smartphones, personal digital assistants, microcontrollers, recording devices, MFDs, etc. Computer system 100 depicted in FIG. 1 can be, for example, a client such as client 210 and/or 212.

Computer system 100 can also be implemented as a server such as server 206, depending upon design considerations. In the depicted example, server 206 provides data such as boot files, operating system images, applications, and application updates to clients 210, 212, and/or 214. Clients 210, 212, and 214 and external device 204 are clients to server 206 in this example. Network data-processing system 200 may include additional servers, clients, and other devices not shown. Specifically, clients may connect to any member of a network of servers, which provide equivalent content.

In the depicted example, network data-processing system 200 is the Internet with network 202 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers consisting of thousands of commercial, government, educational, and other computer systems that route data and messages. Of course, network data-processing system 200 may also be implemented as a number of different types of networks such as, for example, an intranet, a local area network (LAN), or a wide area network (WAN). FIGS. 1 and 2 are intended as examples and not as architectural limitations for different embodiments disclosed herein.

FIG. 3 illustrates a software system 300, which may be employed for directing the operation of the data-processing systems such as computer system 100 depicted in FIG. 1. Software application 305, may be stored in memory 104, on removable storage 112, or on non-removable storage 114 shown in FIG. 1, and generally includes and/or is associated with a kernel or operating system 310 and a shell or interface 315. One or more application programs, such as module(s) or node(s) 125, may be "loaded" (i.e., transferred from removable storage 114 into the memory 104) for execution by the data-processing system 100. The data-processing system 100 can receive user commands and data through user interface 315, which can include input 116 and output 118, accessible by a user 320. These inputs may then be acted upon by the computer system 100 in accordance with instructions from operating system 310 and/or software application 305 and any software module(s) 125 thereof.

Generally, program modules (e.g., module 125) can include, but are not limited to, routines, subroutines, software applications, programs, objects, components, data structures, etc., that perform particular tasks or implement particular abstract data types and instructions. Moreover, those skilled in the art will appreciate that elements of the disclosed methods and systems may be practiced with other computer system configurations such as, for example, handheld devices, mobile phones, smart phones, tablet devices, multi-processor systems, printers, 3D printers, copiers, fax machines, multi-function devices, data networks, microprocessor-based or programmable consumer electronics, networked personal computers, minicomputers, mainframe computers, servers, medical equipment, medical devices, and the like.

Note that the term module or node as utilized herein may refer to a collection of routines and data structures that perform a particular task or implements a particular abstract data type. Modules may be composed of two parts: an interface, which lists the constants, data types, variables, and routines that can be accessed by other modules or routines; and an implementation, which is typically private (accessible only to that module) and which includes source code that actually implements the routines in the module. The term module may also simply refer to an application such as a computer program designed to assist in the performance of a specific task such as word processing, accounting, inventory management, etc., or a hardware component designed to equivalently assist in the performance of a task.

The interface 315 (e.g., a graphical user interface 130) can serve to display results, whereupon a user 320 may supply additional inputs or terminate a particular session. In some embodiments, operating system 310 and GUI 130 can be implemented in the context of a "windows" system. It can be appreciated, of course, that other types of systems are possible. For example, rather than a traditional "windows" system, other operation systems such as, for example, a real time operating system (RTOS) more commonly employed in wireless systems may also be employed with respect to operating system 310 and interface 315. The software application 305 can include, for example, module(s) 125, which can include instructions for carrying out steps or logical operations such as those shown and described herein.

The following description is presented with respect to embodiments of the present invention, which can be embodied in the context of, or require the use of a data-processing system such as computer system 100, in conjunction with program module 125, and data-processing system 200 and network 202 depicted in FIGS. 1-3. The present invention, however, is not limited to any particular application or any particular environment. Instead, those skilled in the art will find that the systems and methods of the present invention may be advantageously applied to a variety of system and application software including database management systems, word processors, and the like. Moreover, the present invention may be embodied on a variety of different platforms including Windows, Macintosh, UNIX, LINUX, Android, Arduino and the like. Therefore, the descriptions of the exemplary embodiments, which follow, are for purposes of illustration and not considered a limitation.

The embodiments disclosed herein are directed to a system to spray and/or fog complete buildings and facilities of all types, or sub-spaces in such buildings or facilities. The embodiments can generally include a product mixer operably connected to air compression devices, as well as complete piping and nozzle systems distributed throughout the facility/building. The system is configured to distribute disinfecting spray or fog from the product mixer to individual spaces in the building via the piping and nozzle systems and then pull a vacuum to remove the spray or fog, with a suction assembly. The system can be partially or fully automated using software to implement control logic for a valve system that distributes the spray or fog to designated areas of the facility to treat at designated times.

Figure 4:
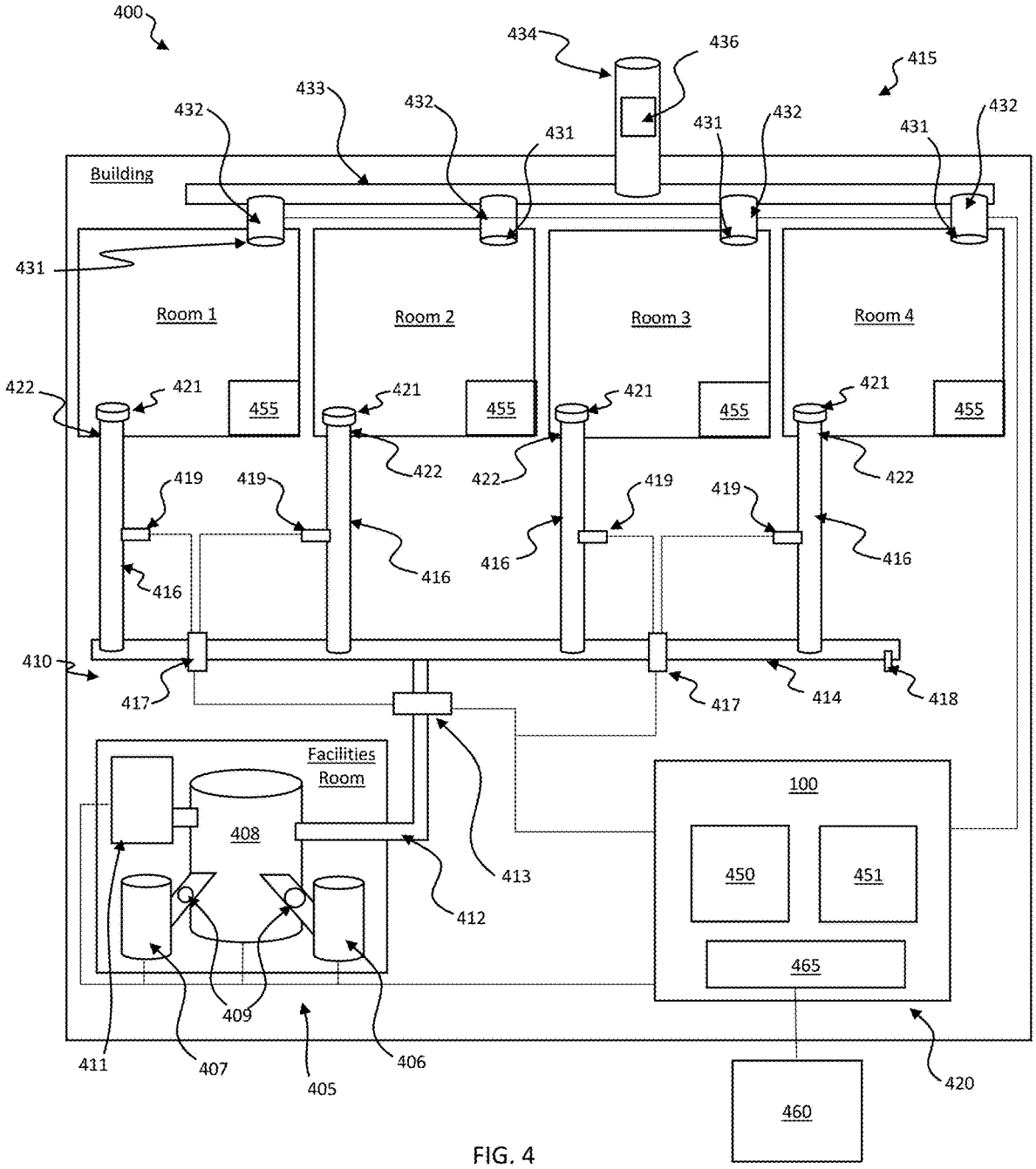
FIG. 4 depicts a block diagram of a treatment system, in accordance with the disclosed embodiments.

A system for treating an enclosed environment 400 is illustrated in FIG. 4. The system 400 can generally comprise a storage distribution assembly 405, distribution piping 410, an exhaust assembly 415, and a control system 420.

the storage and distribution assembly 405 can be located, for example, in a facilities room, maintenance room, closet, utility area, exterior environment, or other such space. The storage and distribution assembly 405 can include a treatment compound tank A 406 and a treatment compound tank B 407 fluidically connected to a main storage tank 408. It should be appreciated that the number of compound tanks illustrated is exemplary, and additional compound tanks might also be required depending on the chemical compounds used for treatment. The fluidic connection between the compound tanks 406 and 407, and the main storage tank 408 can be piping. In certain embodiments, the compound tanks 406 and 407, or piping can be equipped with a pumping mechanism 409 to pump compounds from the compound tanks 406 and 407, to the main storage tank 408.

The main storage tank 408 can serve as the main tank where the treatment compound is mixed and stored. In certain embodiments, the main storage tank 408 can be equipped with, for example, a temperature control unit, agitator, and other such components to ensure the compounds from the treatment compound tanks are properly mixed for distribution.

The main storage tank 408 can be connected to a compressed gas system 411. In an exemplary embodiment, the compressed gas system 411 can supply compressed air to the main storage tank 408. In other embodiments, the compressed gas can be selected according to the desired application. The main storage tank 408 can comprise a pressure tank, in embodiments where a compressed gas system 411 is attached. Compression fitting and piping can be used to connect the compressed gas system 411 to the main storage tank 408. When the compressed gas system 411 is used, the pressure in the main storage tank 408 can serve to drive the treatment compound through the main distribution line 412 to the distribution valve 413 for treatment of various environments. In other embodiments, a pump can be used to distribute the treatment compound from the main storage tank 408. A pump can also be used to augment treatment compound flow even when the treatment tank 408 is pressurized.

The main distribution line 412 can connect the storage tank 408 to a trunk distribution line or lines 414. The main distribution line 412 can include a main distribution valve 413 that can be used to close the distribution system 410. The main distribution valve 413 can include a manual shut off as well as an electronically controlled shut off which can be controlled with the controller 420. In the case of emergency, the main distribution valve 413 can be shut off automatically or by hand to prevent the distribution of any treatment compound.

The trunk distribution line 414 can be connected to one or more room distribution lines 416. One or more pumps 417 can be configured in the trunk distribution line 414 to facilitate distribution of the treatment compound from the main distribution line 414 to the room distribution lines 416, which ultimately distribute the treatment compound into the desired environment. It should be noted that in some embodiments, the trunk distribution line 414 may be directly connected to an environment and can be used to distribute treatment compound to such an environment. The trunk distribution line 414 can also include a low point drain 418, configured to allow residual treatment compound to be flushed out of the system 400.

Each room distribution line 416 can be fitted with a valve 419. The valve 419 can be opened or closed manually or via an electronic control signal. In general, the valve 419 can be used to control whether or not treatment compound is distributed into the associated environment. In the exemplary embodiment illustrated in FIG. 4, this corresponds to one of Room 1, Room 2, Room 3, and Room 4, but in other embodiments, other building arrangements and associated room distribution line architecture can be used.

The room distribution lines 416 can be fitted with nozzles 421 distributed in the respective room via a room inlet 422. The term "nozzle" as used herein is meant to describe any fitting that can be used for spraying, misting, fogging, or distributing treatment compound. In certain embodiments, the type of nozzle can be selected according to the desired application and the type of treatment compound being distributed.

The various lines and/or piping can be comprised of various materials according to the specific application of the system. In certain embodiments, the material choices include, but are not limited to, polyethylene cross linked pipe (PEX), polyvinyl chloride pipe (PVC), Acrylonitrile Butadiene Styrene (ABS), copper or steel pipe, etc. The piping and nozzles can be appropriately sized to deliver the desired amount of product to each space. The piping system can be modified as necessary to meet capacities as well as applicable building codes, or other such regulations. In certain embodiments, the piping can be installed in or in association with, the existing HVAC system in the facility.

The storage and distribution assembly 405 and the piping assembly 410 are used together as the infrastructure for deployment of treatment compound to one or more areas in the enclosed environment.

The system 400 further includes an exhaust system 415 configured to remove the treatment compound from the enclosed environment after treatment is complete. The exhaust system 415 generally comprises a vent 431 configured in each enclosed environment. Each exhaust vent 431 can include a fan and valve assembly 432. The valve allows the fluidic pathway from the vent to be opened or closed. The fan can be used to pull fluids in the enclosed environment into the vent.

Each of the vents 431 can be connected to a trunk vent 433 which is further connected to an exhaust vent 434. In an exemplary embodiment the exhaust vent 434 can vent to the outdoors. However, it should be appreciated that in other embodiments the exhaust vent 434 can also vent to other areas including plenums, wall cavities, other rooms (e.g. vacant adjacent rooms, crawl spaces, or other such areas. In certain embodiments, a filter 436 can be configured in the exhaust vent 434 to remove any undesired compounds before venting. The filter 436 can be removable and replaceable.

The exhaust vent 343 can also include a properly sized fan or vacuum pulling system to vent the associated enclosed environments. Elements of the exhaust system 415 can be configured of HVAC compliant ducting and can be configured in, or in association with the existing HVAC system in the facility. The system 415 can be modified to meet capacity and to comply with industry defined standards, building codes, and the like. The venting system 415 is another part of the infrastructure associated with the disclosed system 400 that allows the system 400 to effectively and efficiently treat an enclosed environment.

In practice, the system 400 can be controlled with a control system 420. The control system 420 can generally comprise a computer system 100 as described above and in FIGS. 1-3. The control system 420 can include a control module 450 and a user interface 451, such as a graphical user interface that allows an administrator to control the system 400.

One aspect of the control system 420 is to control the mixing and distribution of treatment compounds via the storage and distribution assembly 405. The computer system 100 can be operably connected to the compressed air assembly 411, treatment compound tanks 406 and 407, main tank 408, pump 409, and other features of the storage and distribution assembly. The connection can be a wired connection or wireless internet connection. The control system 420 can be used to pump treatment compounds from the treatment compound tanks 406 and 407 in the proper quantities, into the storage tank 408. The treatment compound tanks 406 and 407 can be metered, and readings from the meters can be used to ensure proper amounts are distributed to the storage tank 408. This can be an "on demand" type feature meaning that the total distributable treatment compound can be actively monitored and adjusted as necessary to meet demand. The treatment compound tanks 406 and 407 can also be configured to provide flags or reminders when the level of compound decreases and must be replenished.

The main storage tank 408 can include a sensor to measure tank fullness and tank temperature. The control system can control an agitator configured in the storage tank 408 to ensure proper mixing of treatment compounds as necessary to generate the desired treatment compound for distribution.

The control system 420 can further control the compressed air assembly 411 so that the main storage tank 408 is held at the desired pressure. Input from a pressure sensor associated with the compressed air assembly 411 and/or main storage tank 408 can be provided to the control system 420 and the control system 420 can in turn regulate the pressure.

The control system 420 can further automate distribution of treatment compound to various areas of the enclosed environment. For example, the control system 420 can include a scheduling function that allows an administrator to establish timing of treatment compound distribution in each of the designated areas (e.g. rooms) in the enclosed environment. The control system 420 can send instructions to the main distribution valve 413, as well as the valves 419 on the room distribution lines 416 to allow treatment compound to be dispersed into the desired room at the desired time. The administrator can further set the total time of distribution. When that time is reached, the control system 420 can instruct the fan and valve assembly 432 associated with the exhaust system 415 to draw and exhaust the remaining treatment compound out of the room.

The control system 420 can further be configured in a fully autonomous mode. In such a mode, proximity or motion sensors 455 in each of the rooms can be used to determine if the room is vacant. The control system 420, upon finding a room vacant, can activate the necessary valves to treat and vent the environment.

In certain embodiments, the control system 420 can integrate with the building occupancy records to verify a room is vacant. For example, in the case where the building comprises a hotel, the control system 420 can interface with the hotel's internal computer system to check if a room is occupied by a guest or vacant. Upon determining that the room is vacant, a motion detector 455 in the room can be used as a safety check to verify the room is vacant. If both checks indicate the room is vacant the control system 420 can open the valve 419 so that treatment compound can be dispersed into the vacant room. After treatment is complete the exhaust system 415 can be activated by the control system 420 to exhaust any residual treatment compound in the room.

In certain embodiments, the GUI 451 can provide a visual indication or map of all the treatment locations in the enclosed environment. The system 400 can allow the user to identify treatment areas and times, or to schedule automated treatment for each room. In certain embodiments, the control system 420 can be controlled with a mobile application 460 via a remote interface 465, on a mobile device or tablet device in communication with the computer system 100. In other embodiments the control system can comprise software on a mobile device.

Figure 5:
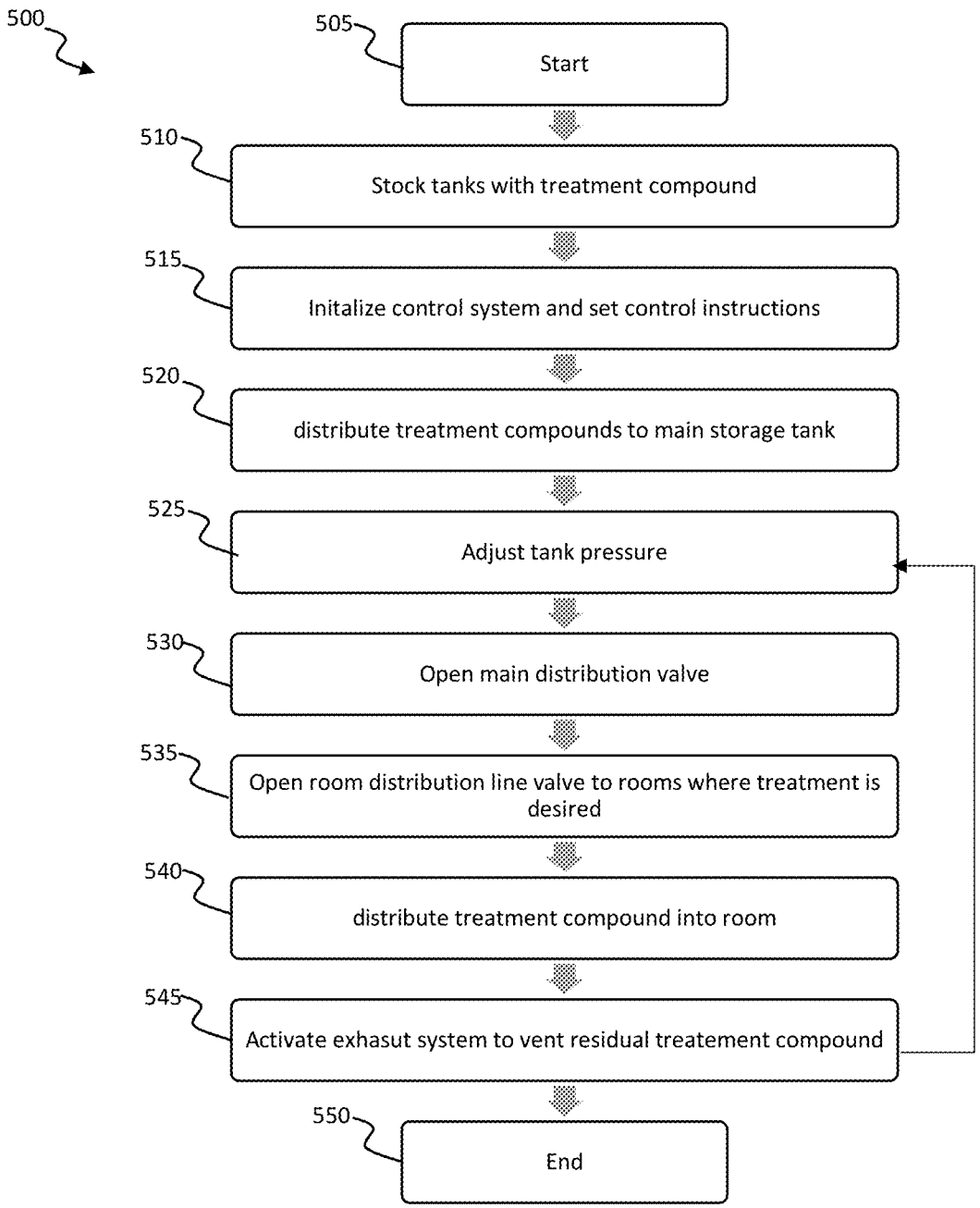
FIG. 5 depicts a flow chart illustrating logical operational steps for treating an enclosed environment, in accordance with the disclosed embodiments.

FIG. 5 illustrates a method 500 for treating and venting a closed environment with disinfectant or pesticides, in accordance with the disclosed embodiments. It should be appreciated that the method illustrated in FIG. 5 is exemplary and additional steps may be included, stapes may be omitted, or the order of steps may be changed, without departing from the scope of the embodiments. The method beings at 505

In an exemplary embodiment, the method continues at 510 by stocking the treatment compound tanks with the compounds necessary to form the desired treatment compound. Next, at step 515 the control system can be initialized to identify all the areas in the enclosed environment. Initial control instructions can be provided indicating parameters such as treatment chemical type, treatment scheduling for each room in the enclosed environment, treatment timing for each room in the enclosed environment, etc. These parameters can be used to adjust tank pressure at step 525, valve status as open or closed, fan and pump operations, and so forth.

With the control system initialized, the system can operate according to the control parameters. In anticipation of treatment, the treatment compounds from the compound tanks can be supplied to the main storage tank. The main storage tank can be agitated to mix the compounds if necessary and other parameters associated with the tank can be monitored. The tank pressure can be adjusted so that treatment compound can be supplied to the required areas in the enclosed environment.

When a scheduled treatment comes due, the main distribution valve can be opened at step 530, and the room distribution line valve can be opened on the distribution line leading to the room where treatment is scheduled as shown at step 535. The treatment compound can be delivered to the room via the pipe system as illustrated at step 540. The treatment compound can then be left to treat the room for the desired amount of time. In certain embodiments, multiple distributions of treatment compound may be desired, or treatment compounds of different types may be delivered to the room is succession.

Once the required treatment time has passed, the control system can close the room distribution line valve, and activate the exhaust system connected to the treated room as shown at step 545. The exhaust system can vent the residual treatment compound in the room, to the exhaust point. It should be apricated that this series of steps can be repeated, or processed in parallel, for other rooms in the enclosed environment according to the schedule provided to the control system. The method then ends at step 550.

Additional exemplary embodiments are further detailed herein. It should be appreciated that some or all aspects of such embodiments, can be implemented in association with other aspects and embodiments disclosed herein. The mechanical systems disclosed in such exemplary embodiments can be controlled with digital and analog control modules. Data relating to the mechanical system can also be collected using sensors and organized using the same digital and analog control modules. In certain embodiment, a computer software application can communicate with the control modules via wired or wireless communication (including but not limited to ethernet, WIFI and/or cellular networks) to give commands and to receive operational and historical data.

Figure 6:
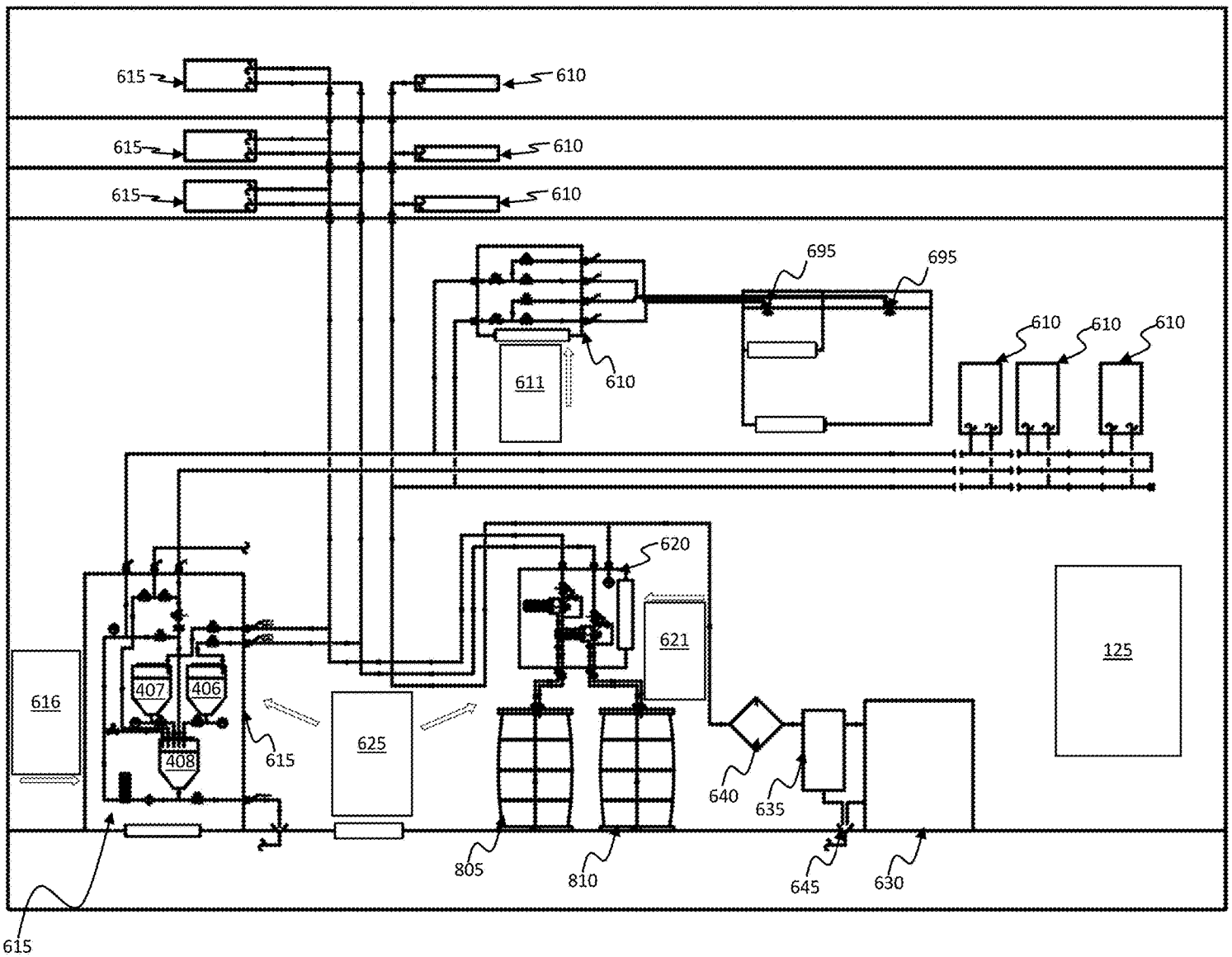
FIG. 6 depicts a block diagram of another embodiment of a treatment system, in accordance with the disclosed embodiments.

FIG. 6 illustrates architecture of an exemplary system 600. The system 600 includes a zone box 615 which can provide treatment compound(s) to specified zones and specific rooms via room boxes 610. The room boxes 610 can then operate nozzles through which the fog/spray (treatment compound) is dispersed into the appropriate space.

The system 600 is configured to be scalable. To add additional capacity, additional zone boxes 615 can be installed thereby giving the ability to add additional room boxes 610. In certain embodiments a main box 620 can also be used, for the purpose of automatically refilling product into single or multiple zone boxes 615.

All the mechanical equipment in system 600 can be controlled (e.g. started, stopped, opened, closed, monitored, etc.) utilizing control modules, in communication with or integrated in, each zone box 615, room box 610, and/or main box 620. Every zone box control module 616, room box control module 611, and main box control module 621 can be configured to be in communication with one or more other control modules. This communication is provided via the respective zone box control module 616, room box control module 611, and/or main box module 621. Communication can be provided via ethernet cable, cellular networks, WIFI networks or the like. Communication between the different control modules (or controllers) allows operation and monitoring of every piece of mechanical equipment integrated in the system 600. All such information can be further communicated to a software application, such as software application module 125, which can show operational data in real time as well create historical data of product usage, mechanical time of operation, and any malfunctions of equipment via a user interface. In other embodiments, the control modules (e.g. the zone box control module 616, room box control module 611, main box module 621, etc.) can be embodied as software associated with software application module 125.

The control module 616 operating the zone box(s) 615 can serve as the master controller. The control modules 611 operating the room boxes 610 and/or the control modules 621 operating the optional main box(s) 620 are subservient controllers. In certain, optional configurations, the zone box 615 and the main box 620 can be controlled with a combined zone/main control module 625 that acts as the master to the room box control module 611.

The mechanical exhaust system, as detailed in other exemplary embodiments, can be controlled and monitored by either the room box control module 611, zone box control module 616, or combination zone/main box control module 625. In certain circumstances, the combination zone/main box control module 625 can be replaced by utilizing separate zone box control modules 616 and main box control modules 621. In this configuration the zone box control module 616 is the master controller, and the main box control module 621 is the subservient controller. The relationship between the zone box control modules 616 and the room box control modules 611 always remains the same.

The zone box control module 616 can be configured to provide control, and data collection information. The human interface and instruction can be provided via the zone box control module 616, which can include a control panel 617. In addition instruction and display from the zone control box module 616 can be provided via a GUI associated with a computer software application such as module 125 developed for this purpose.

The zone box control module 616 can be used to set a schedule for specific days and times to begin the complete product distribution to the nozzles. Similarly the zone box control module 616 can be used to specify and modify the length of time of treatment compound distribution and spray via each room box 610. The zone box control module 616 can be used to specify which room boxes 610 will activate during a treatment compound distribution cycle.

The zone box control module 616 can send control signals to open and close appropriate valves to fill the main tank 408 from part A tank 406 and part B tank 407 to predetermined levels. The zone box control module can also start and stop the air compressor for specific periods of time. The zone control module 616 can further open and close the appropriate valves to route treatment compound in main tank 408 and compressed air to predetermined room boxes 610 within the zone. When necessary, the zone box control module 616 can determine which room boxes 610 require treatment compound and can initiate and terminate the pumping processes from the main tank 408 to the appropriate room boxes 610. The zone control module 616 can then send commands and/or monitors each room box 610 to open and close the appropriate main tank product and compressed air valves to allow treatment compound distribution through the nozzles for a specific period of time.

The zone box control module 616 also serves as a monitor and can report liquid levels in part A tank 406, part B tank 407, and main tank 408. As necessary, the zone box control module 616 opens and closes any necessary valves for servicing or cleaning the equipment, and can monitor time intervals and lengths of time of operation on all mechanical equipment, pumps, and valves. The zone box control module 616 can report any mechanical malfunctions to the software application 125, and can provide emergency shutoff when appropriate.

In certain embodiments, the zone box control module 616 can also monitor all compressed air and liquid product pressures in real time, and can report all real time data, historical data, and operational data to the software application 125.

Finally, the zone box control module 616 can start and stop any exhaust fans or HVAC air handlers as specified through the control panel or software 125 for predetermined lengths of time.

The zone/main box control module 625 can include all the functions of the zone box control module 616. In addition, when the liquid levels of part A tank 406 and part B tank 407 in the zone box 615 fall to a predetermined level, the zone/main box control module 625 can initiate the process of refilling part A tank 406 and part B tank 407 from the respective larger storage containers located in the main box 620. This is accomplished by starting and stopping appropriate pumps as well as opening and closing the appropriate valves. The zone/main box control module 625 shuts down the refilling process when the part A and part B containers reach a predetermined level. The zone/main box control module 625 can likewise monitor the levels of the larger storage containers in the main box 620 and report when the levels fall to a predetermined level. As necessary the zone/main box control module 625 can report when the larger part A and/or part B containers in the main box 620 have been replaced.

The zone/main box control module 625 can open and/or close the appropriate valves for main box 625 cleaning and maintenance. The zone/main box control module 625 can also report all real time data, historical data, and operational data to the software application as well as any mechanical malfunctions to the software application 125. The zone/main box control module 625 can provide for emergency shutoff when appropriate.

The main box control module 621 can be associated with the main box 620. The main box control module 621 can report when the liquid levels of part A tank 406 and part B tank 407 in the zone box 615 fall to a predetermined point, and can begin the process of refilling part A tank 406 and part B tank 407 from the respective larger storage containers located in the main box 620. This is entails starting and stopping appropriate pumps as well as opening and closing the appropriate valves. The main box control module 621 can also stop the refilling process when part A tank 406 and/or part B tank 407 reach a predetermined level.

The main box control module 621 can also continuously monitor the product levels of the larger storage containers in the main box 620 and report when the levels fall to a predetermined level. The main box control module 621 can also report when the larger part A and/or part B containers in the main box 620 have been replaced.

The main box control module 621 can open and close the appropriate valves for main box 620 cleaning and maintenance. The main box control module 621 can reports all real time data, historical data, and operational data, as well as any mechanical malfunctions to the software application 125. The main box control module 621 provides for emergency shutoff when appropriate.

The main box control module 621 can also monitor time intervals and length of time of operation on all mechanical equipment, pumps, and valves located within the main box, and all compressed air and liquid product pressures in real time. The main box control module 621 can report all such real time data, historical data, and operational data to the software application 125.

The room box control module 611 serves as the controller for the room boxes 610. For example the room box control module 611 can open and close appropriate liquid supply valves and compressed air supply valves to allow the liquid and compressed air to be dispensed through the nozzles. The room box control module 611 can also report, and confirms all open valves and all closed valves, and can monitor and report the length of time the valves are open in each cycle. The room box control module 611 can also interface with an occupancy sensor in the room where appropriate, and can provide for emergency shutoff via the room box 610 if necessary. The room box control module 611 also starts and stops exhaust fans and/or HVAC air handling equipment for predetermined lengths of time as required. The room box control module 611 can report all real time data, historical data, and operational data, as well as any mechanical malfunctions to the software application 125.

The software application (also referred to as a user controller) 125 can be embodied as a graphical user interface available via a computer system 100, or mobile device. The functionality of the zone box control module 616 is mirrored by the user controller 125, but the user controller 125 can further provide an intuitive human interface to operate, monitor, and analyze real-time and historical data. The application software 125 can connect to, and communicate with, the zone box control module 616 via wired or wireless connecting means as detailed herein.

The application software 125 can incorporate security functions, including but not limited to, a username, a user password, a pin, and two factored authentication to prevent unauthorized access. In certain embodiments, the application software 125 can have different tiers of users which can have different access to information and commands. This allows for the segregation of administrative access and user access. The administrator can access all functions, commands, and data provided by the system 600. The administrator will be able to set up users and user access—determining which functions and data are available to each individual user.

The user control will allow administrative access to the zone box control module 616 (or other control modules if necessary) to extract historical data, extract real time data, monitor functionality, lockout users, add users and troubleshoot malfunctions as well as any other functions available.

The graphical user interface associated with the application software 125 will allow a user to perform and monitor all the functions of the zone box control module 616, room box control module 611, zone/main box control module 625, and main box control module 621 as required by the specific installations and according to the specified user settings and access controls. As such, the application software 125 can monitor and report all functions, malfunctions, and operational data as being gathered by the zone box control module 616. The application software can utilize data collected to create historical information on product usage, equipment operational time, and all functions and malfunctions of the complete system 600.

The application software 125 can provide for emergency shutoff when appropriate, and can provide alerts for specific functions and data via text message, email, or other such notifications. The application software can provide an interface that is available in multiple languages.

Figure 7:
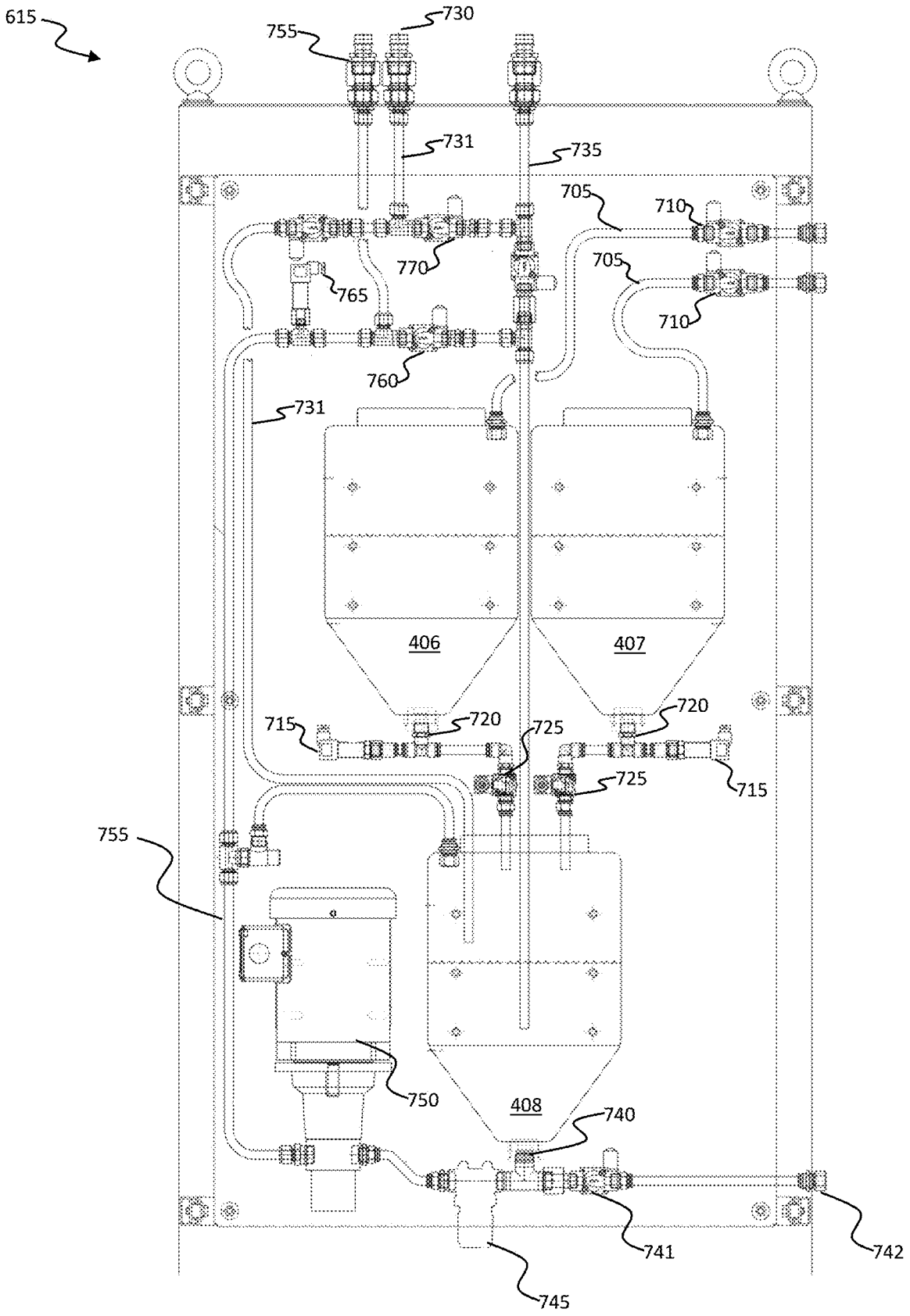
FIG. 7 depicts a diagram of a zone box, in accordance with the disclosed embodiments.

The system 600 includes additional hardware and software aspects illustrated in FIG. 6. FIG. 7 illustrates aspects of the zone box 615 in accordance with the disclosed embodiments. The zone box 615 can include part A tank 406 and part B tank 407. The respective tanks can be connected to larger supply tanks via supply lines 705 fitted with valves 710 (the valves disclosed herein can comprise, mechanically operated valves, solenoid valves, or other such valves. Each of the tanks 406 and 407 can be fitted with pressure/temperature gauges 715 and outlet lines 720 leading to the main tank 408. Flow through the outlet lines can be controlled with valves 725.

The main tank 408 can further be connected to a municipal water supply 730 (or other such water supply) via a water supply line 731 controlled with a valve 732. A liquid return line 735 can also be used to return excess treatment compound to the main tank 408 for redistribution.

The main tank 408 can have a single output line 740, which can include a drain valve 741 limiting flow to a low point drain 742 in fluidic connection with a sanitary system drain. When the drain valve 742 is closed, mixed treatment compound can be provided through a filter 745 and circulator 750 to one or more room boxes via a distribution line 755. The distribution line 755 can be fitted with a return line and overpressure relief valve 760 which reconnects to the main tank 408. The distribution line 755 can also be fitted with a pressure/temperature sensor 765 and can reconnect to the liquid return line with a valve 770.

Figure 8:
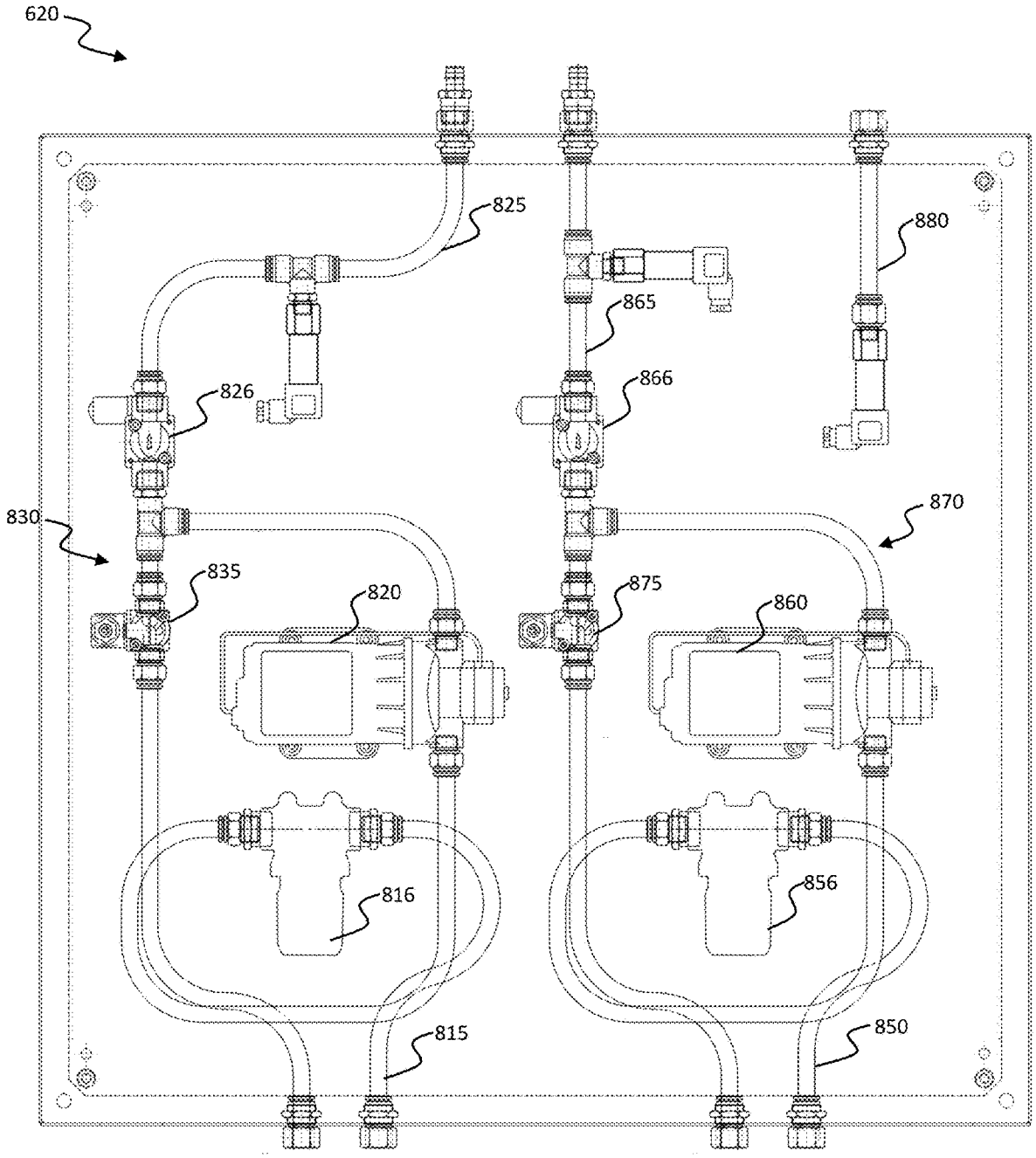
FIG. 8 depicts a diagram of a main box, in accordance with the disclosed embodiments.

The main box 620 serves primarily to supply additional part A compound and part B compound from part A storage tank 805 and part B storage tank 810. Details of the main box 620 are illustrated in FIG. 8. The main box 620 includes a supply suction line 815 with an inline filter 816 from the part A storage tank 805 to a part A pump 820. The part A pump 820 is then connected to the part A tank 406 via a line 825 controlled with valve 826. The part A pump 820 can also be connected to an overflow loop 830 with an overpressure relief valve 835 with the overflow loop connecting back to the line to the part A tank with a valve, and, when that valve is closed, back to the part A storage tanks. Similarly, the main box 620 includes a supply suction line 850 with an inline filter 856 from the part B storage tank 810 to a part B pump 860. The part B pump 860 is then connected to the Part B tank 407 via a line 865 controlled with a valve 866. The part B pump 860 can also be connected to an overflow loop 870 with an overpressure relief valve 875 with the overflow loop 870 connecting back to the line to the part B tank with a valve, and, when that valve is closed, back to the part B storage tank.

In certain embodiments, an inline air compressor 630, dryer 635, and filter 640 can be used to supply compressed gas to the main box 620 via compressed gas reference line 880, as well as the room boxes 610 as necessary, as illustrated in FIG. 6. The air compressor 630 and dryer 635 can be fitted with waste lines 645, which can connect to a sanitary drain.

Figure 9:
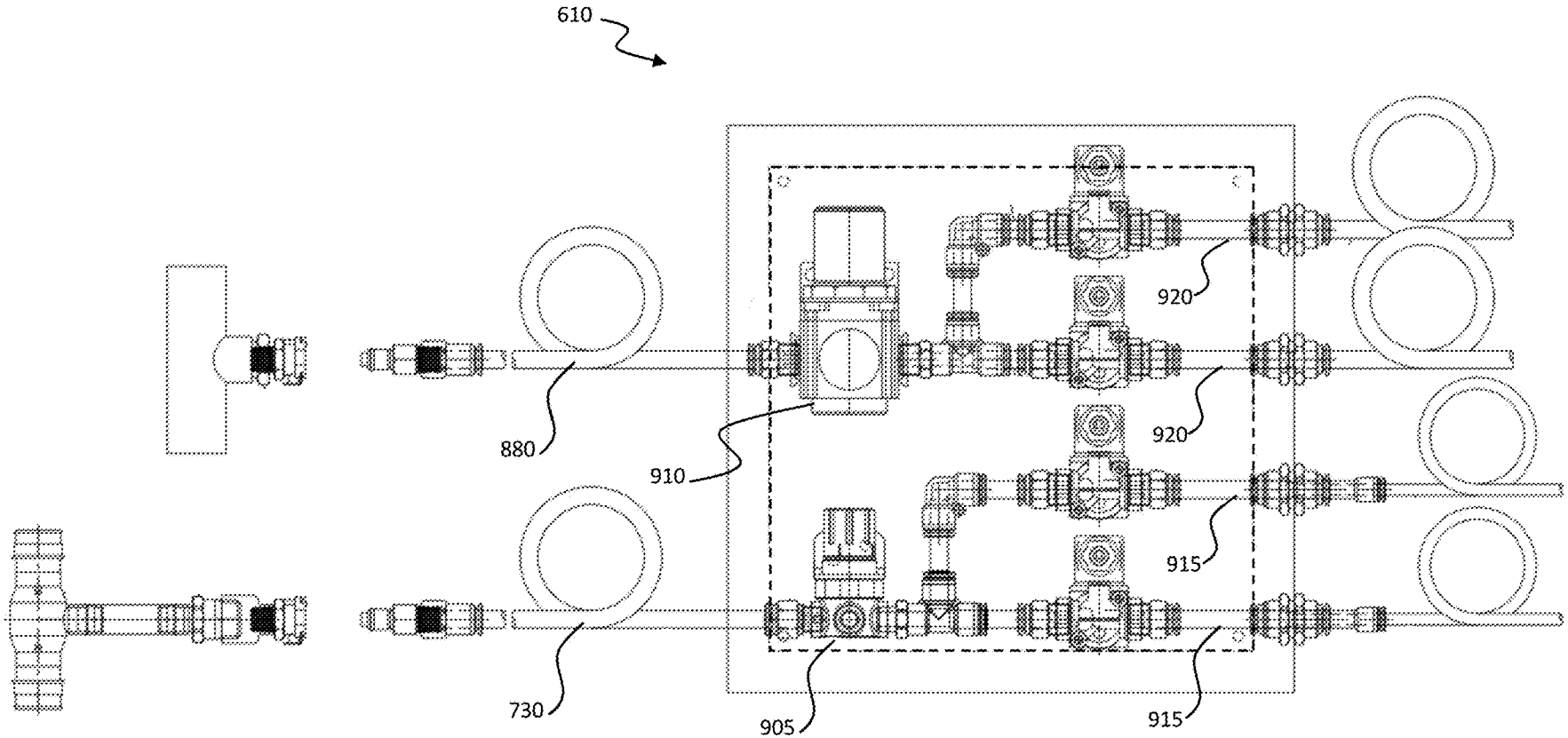
FIG. 9 depicts a diagram of a room box, in accordance with the disclosed embodiments.

Each room or environment configured for treatment can be fitted with a room box 610. It should be appreciated that one or more rooms can be batched into a zone, which is supplied with treatment and controlled via the associated zone box 615. FIG. 9 illustrates aspects of the room box 610 in accordance with the disclosed embodiments. The supply line 730 from the respective zone box 615 can be connected to the room box 610 via an inline pressure regulator 905. Likewise, compressed gas from the air compressor line 880 can be supplied to the room box 610 via an inline pressure regulator 910.

The respective inline pressure regulators 905 and 910 can then be split into one or more valve controlled lines, lines 915 for the fluid lines and lines 920 for the gas lines. FIG. 6 and FIG. 9 illustrates two such treatment compound supply lines 915 and two such gas supply lines 920, in order to reach a main room and connected bathroom. In other, embodiments, more or fewer lines can be split as required to service the integrated rooms. The gas supply lines 920 and treatment compound supply lines 915 can each be connected to a nozzle 695 integrated into the respective room. The nozzle 695 can distribute the treatment compound as a mist, fog, spray, or the like to treat the environment.

As illustrated in FIG. 6 multiple zone boxes 615 can be provided to services multiple rooms via room boxes 610. For example, a zone can be configured as one floor of a multi-floor building, with all the rooms on the floor within the zone. The system 600 can thus be configured to tailor treatment options in each zoom. In addition, the system can be extended to new or additional areas of a building in stages.

It should be appreciated that the systems and methods disclosed herein can be used for treatment of any areas, enclosures, or surfaces, such as, but not limited to porous and non-porous surfaces, and air treatment for airborne contaminants. It should also be understood that the disclosed embodiment has been presented as a means for distributing disinfectant and/or pesticide. In other embodiments, the system can address other needs, such as, but not limited to mold remediation, HVAC treatments, fire and smoke damage, odor elimination, biohazard restoration, meth-lab cleanup, crime scene cleanup, virus/bacteria disinfection, VOCs neutralization, pest control, indoor air quality management of toxins, allergens, and irritants, asthma, allergic reactions, and chemical sensitivity.

Based on the foregoing, it can be appreciated that a number of embodiments, preferred and alternative, are disclosed herein. For example, in an embodiment, a compound distribution system comprises a storage and distribution assembly for storing a treatment compound, a pipe system for delivering the treatment compound from the storage tank to an environment, and an exhaust system configured to exhaust the treatment compound out of the environment. In an embodiment, the system comprises a computer system communicatively coupled to the storage and distribution assembly, the pipe system, and the exhaust system, the computer system comprising: at least one processor and a storage device communicatively coupled to the at least one processor, the storage device storing instructions which, when executed by the at least one processor, cause the at least one processor to perform operations comprising: controlling distribution of the treatment compound from the storage and distribution assembly to the environment and controlling the exhaust system to exhaust the treatment compound out of the environment.

In an embodiment, the storage and distribution assembly further comprises a main storage tank, at least one compound tank configured to supply treatment compound to the main tank, and a compressed gas assembly configured to provide compressed gas to the main storage tank. In an embodiment, the pipe system further comprises a main distribution line, a main distribution valve in the main distribution line, at least one room distribution line, and a room distribution line valve associated with each of the at least one room distribution lines. In an embodiment, the exhaust system further comprises at least one vent in the environment, at least one vent fan configured to draw fluid out of the environment through the at least one vent, and an exhaust vent configured to expel the treatment compound.

In an embodiment, a distribution and exhaust system comprises at least one room box configured to deliver treatment compound to a nozzle disposed in an environment, at least one zone box configured for delivering a treatment compound to the at least one room box, and an exhaust system configured to exhaust the treatment compound out of the environment.

In an embodiment the distribution and exhaust system further comprises a main box configured to provide at least one component of the treatment compound to the zone box. In an embodiment, the distribution and exhaust system further comprises an air compressor in fluidic connection with at least one of the zone box and the room box. In an embodiment, the distribution and exhaust system further comprises a dryer configured between the air compressor and at least one of the zone box and the room box and a filter configured between the air compressor and at least one of the zone box and the room box. In an embodiment, the zone distribution box further comprises a main storage tank and at least two compound tanks configured to supply treatment compound to the main tank.

In an embodiment, the exhaust system further comprises at least one vent in the environment, at least one vent fan configured to draw fluid out of the environment through the at least one vent, and an exhaust vent configured to expel the treatment compound.

In an embodiment, the distribution and exhaust system further comprises a computer system communicatively coupled to at least one of the zone box and the room box, and the exhaust system, the computer system comprising at least one processor, and a storage device communicatively coupled to the at least one processor, the storage device storing instructions which, when executed by the at least one processor, cause the at least one processor to perform operations comprising: controlling the zone box, controlling distribution of the treatment compound with the room box, and controlling the exhaust system to exhaust the treatment compound out of the environment.

In an embodiment, the at least one room box comprises a plurality of room boxes associated with one of the at least one zone boxes.

In an embodiment, a treatment method comprises storing a treatment compound in a storage and distribution assembly, delivering the treatment compound from the storage and distribution assembly to an environment with a pipe system, and exhausting the treatment compound out of the environment with an exhaust system. In an embodiment, the treatment method further comprises controlling distribution of the treatment compound from the storage and distribution assembly to the environment with a computer system and controlling the exhaust system to exhaust the treatment compound out of the environment, with the computer system.

In an embodiment of the treatment method the storage and distribution assembly further comprises a main storage tank, at least one compound tank configured to supply treatment compound to the main tank, and a compressed gas assembly configured to provide compressed gas to the main storage tank. In an embodiment, of the treatment method the pipe system further comprises a main distribution line, a main distribution valve in the main distribution line, at least one room distribution line, and a room distribution line valve associated with each of the at least one room distribution lines.

In an embodiment, the treatment method further comprises opening at least one vent in the environment, drawing fluid out of the environment through the at least one vent with at least one vent fan, and expelling the treatment compound through an exhaust vent. In an embodiment, the treatment method further comprises verifying the environment is vacant with an occupancy detector before delivering treatment compound to the environment. In an embodiment, the treatment method further comprises scheduling delivery of the treatment compound to an environment.

It should be appreciated that variations of the above-disclosed and other features and functions, or alternatives thereof, may be desirably combined into many other different systems or applications. It should be understood that various presently unforeseen or unanticipated alternatives, modifications, variations or improvements therein may be subsequently made by those skilled in the art which are also intended to be encompassed by the following claims.

What is claimed is:

1. A compound distribution system comprising:

a storage and distribution assembly for storing a treatment compound comprising:

a first treatment compound tank;

a second treatment compound tank; and a main storage tank configured to receive a first treatment compound from a first treatment compound tank and a second treatment compound from a second treatment compound tank;

a pipe system for delivering the treatment compound from the main storage tank to an environment, the pipe system comprising:

a main distribution line connecting the main storage tank to a trunk distribution line;

a main distribution valve in the main distribution line configured to close the main distribution line;

at least one pump configured in the trunk distribution line configured to distribute treatment compound to at least two room distribution lines wherein each of the at least two room distribution lines is routed to a different room;

a nozzle attached to each of the at least two room distribution lines; and a low point drain configured in the trunk distribution line to allow residual treatment compound to be flushed out of the trunk distribution line; and an exhaust system configured to exhaust the treatment compound out of the environment, the exhaust system comprising:

at least one vent in the environment;

a trunk vent connecting the at least one vent in the environment to an exhaust vent; and at least one vent fan configured to draw fluid out of the environment through the at least one vent, through the trunk vent, and to expel the treatment compound out of the environment.

2. The compound distribution system of claim 1 further comprising a computer system communicatively coupled to the storage and distribution assembly, the pipe system, and the exhaust system, the computer system comprising:

at least one processor; and a storage device communicatively coupled to the at least one processor, the storage device storing instructions which, when executed by the at least one processor, cause the at least one processor to perform operations comprising:

controlling distribution of the treatment compound from the storage and distribution assembly to the environment; and controlling the exhaust system to exhaust the treatment compound out of the environment.

3. The compound distribution system of claim 1 wherein the storage and distribution assembly further comprises:

a first pump configured to pump the first treatment compound from the first treatment compound tank to the main storage tank;

a second pump configured to pump the second treatment compound from the second treatment compound tank to the main storage tank; and compressed gas provided to the main storage tank.

4. The compound distribution system of claim 1 wherein the pipe system further comprises:

a room distribution line valve associated with each of the at least two room distribution lines.

5. The compound distribution system of claim 1 wherein the exhaust system further comprises:

a filter in the exhaust vent.

6. A distribution and exhaust system comprising:

at least one room box configured to deliver treatment compound and compressed gas to a nozzle disposed in an environment, the at least one room box comprising:

at least one treatment compound supply line;

a first pressure regulator for controlling flow to the treatment compound supply line; at least one gas supply line connected to the nozzle; and a second pressure regulator for controlling gas flow to the at least one gas supply line;

a computer system communicatively coupled to a zone box, the computer system comprising:

at least one processor;

a storage device communicatively coupled to the at least one processor, the storage device storing instructions comprising a zone box control module which, when executed by the at least one processor, cause the at least one processor to perform operations comprising:

controlling distribution of the treatment compound from the zone box to one or more of the at least one room boxes; and an exhaust system configured to exhaust the treatment compound out of the environment, the exhaust system comprising:

at least one vent in the environment;

a trunk vent connecting the at least one vent in the environment to an exhaust vent;

at least one vent fan configured to draw fluid out of the environment through the at least one vent, through the trunk vent, and to expel the treatment compound out of the environment; and a main box configured to provide at least one component of the treatment compound to the at least one zone box, the main box comprising:

a supply suction line; and an inline filter from a part A storage tank to a part A pump further connected to a part A tank and an overflow loop.

7. The distribution and exhaust system of claim 6, wherein the main box further comprises:

a second supply suction line; and a second inline filter from a part B storage tank to a part B pump further connected to a part B tank and a second overflow loop.

8. The distribution and exhaust system of claim 6 further comprising:

an air compressor in fluidic connection with:

the at least one zone box; and the at least one room box.

9. The distribution and exhaust system of claim 8 further comprising:

a dryer configured between the air compressor and at least one of the zone box and the room box; and a filter configured between the air compressor and at least one of the zone box and the room box.

10. The distribution and exhaust system of claim 6, wherein the at least one zone box further comprises:

a main storage tank; and at least two compound tanks configured to supply treatment compound to the main tank.

11. The distribution and exhaust system of claim 6 wherein the exhaust system further comprises:

a filter in the exhaust vent.

12. The distribution and exhaust system of claim 6 wherein the computer system is communicatively coupled to the at least one room box, and the exhaust system, wherein the at least one processor is further configured to perform operations comprising:

controlling a schedule of the distribution of the treatment compound with the room box; and controlling a schedule of the exhaust system to exhaust the treatment compound out of the environment.

13. The distribution and exhaust system of claim 6 wherein the at least one room box comprises a plurality of room boxes associated with one of the at least one zone boxes.

14. A treatment method comprising:

storing a first treatment in a first treatment compound tank;

storing a second treatment compound in a second treatment compound tank;

mixing the first treatment compound and the second treatment compound into a mixed treatment compound in a main storage tank;

delivering the mixed treatment compound from the storage and distribution assembly to an environment with a pipe system, the pipe system comprising a main distribution line connecting the main storage tank to a trunk distribution line;

a main distribution valve in the main distribution line configured to close the main distribution line;

at least one pump configured in the trunk distribution line configured to distribute treatment compound to at least two room distribution lines wherein each of the at least two room distribution lines is routed to a different room; and a nozzle attached to each of the at least two room distribution lines;

a low point drain configured in the trunk distribution line to allow residual treatment compound to be flushed out of the trunk distribution line; and exhausting a fluid out of the environment into an external environment with an exhaust system.

15. The treatment method of claim 14 further comprising:

controlling distribution of the mixed treatment compound from the storage and distribution assembly to the environment with a computer system; and controlling the exhaust system to exhaust the mixed treatment compound out of the environment, with the computer system.

16. The treatment method of claim 14 further comprising:

providing compressed gas to the main storage tank.

17. The treatment method of claim 16 further comprising controlling flow of the mixed treatment compound to each of the at least two room distribution lines with a room distribution line valve associated with each of the at least two room distribution lines.

18. The treatment method of claim 16 further comprising:

opening at least one vent in the environment;

drawing the fluid out of the environment through the at least one vent with at least one vent fan;

filtering the fluid with a filter; and expelling the fluid through an exhaust vent.

19. The treatment method of claim 14 further comprising:

verifying the environment is vacant with an occupancy detector before delivering the mixed treatment compound to the environment.

20. The treatment method of claim 14 further comprising:

scheduling delivery of the mixed treatment compound to an environment.

* * * * *